United States Patent [19]

Breckle

[11] Patent Number: 4,907,309

[45] Date of Patent: Mar. 13, 1990

[54] POCKET-SPRING CORE MATTRESS

[76] Inventor: Andreas Breckle, Am Waldrand 8, 3410 Northeim, Fed. Rep. of Germany

[21] Appl. No.: 235,017

[22] Filed: Aug. 22, 1988

[30] Foreign Application Priority Data

Aug. 24, 1987 [DE] Fed. Rep. of Germany ..... 3728148

[51] Int. Cl.[4] ..... A47C 27/05

[52] U.S. Cl. ..... 5/477; 5/480

[58] Field of Search ..... 5/477, 480, 481

[56] References Cited

U.S. PATENT DOCUMENTS

| | | | |
|---|---|---|---|
| 1,725,479 | 8/1929 | Rissman | 5/477 X |
| 3,099,021 | 7/1963 | Wetzler | 5/477 |
| 3,251,078 | 5/1966 | Calla | 5/477 |
| 4,429,427 | 2/1984 | Sklar | 5/477 |
| 4,485,506 | 12/1984 | Stumpf et al. | 5/477 |

FOREIGN PATENT DOCUMENTS

| | | | |
|---|---|---|---|
| 635502 | 4/1983 | Switzerland | 5/481 |

*Primary Examiner*—Michael F. Trettel
*Attorney, Agent, or Firm*—Thomas & Kennedy

[57] ABSTRACT

A pocket-spring core mattress has a plurality of interconnected encased helical springs (8), each helical spring being arranged in a closed pocket (5) made of fabric, nonwoven or the like. The closed pockets (5) are arranged connected to one another as bands (1, 2, 3, 4) in one direction and are connected by adhesive bonding transversely relative to the direction of the bands. Parallel to the direction of the bands (1, 2, 3, 4), between every two adjacent bands there is a connecting wall (9) made of elastic material. The pockets (5) of the bands (1, 2, 3, 4) are respectively bonded adhesively to one another indirectly via a connecting wall (9).

6 Claims, 2 Drawing Sheets

POCKET-SPRING CORE MATTRESS

FIELD OF THE INVENTION

The invention comprises a pocket-spring core mattress with a plurality of interconnected encased helical springs, each helical spring being arranged in a closed pocket made of fabric, plastic or the like, and the closed pockets being arranged connected to one another as bands in one direction and being connected by adhesive bonding transversely relative to the direction of the bands. The invention can be used for the most diverse types of helical springs, for example cylindrical springs, barrel springs or even waisted springs. Such a pocket-spring core mattress is a spring core structure, that is to say an interconnected structure of encased helical springs, which forms a constructional element for a complete mattress and which is appropriately completed by cushioning and supports and by a covering.

BACKGROUND OF THE INVENTION

A pocket-spring core mattress of the type described in the introduction is known from European Preliminary Publication 154,076. Here too, bands or rows of closed pockets are formed, a helical spring being accommodated in each pocket. The bands or rows are connected to one another transversely relative to the direction of the band or of the row by coating an adhesive onto a tangential line of the pocket or onto the tangential lines of the pockets in one row and by pressing on the pockets of the adjacent row along the contact line or contact lines. A field arrangement of the individual pockets is thus possible, that is to say an arrangement in which the axes of the interconnected pockets or helical springs are arranged respectively at right angles to one another. The coating of the adhesive can be carried out in individual strips or in individual spots and connects the material of the pockets together directly transversely relative to the direction of the bands. For this purpose, the pockets of adjacent rows have to be pressed onto one another, and a certain setting time is necessary for the adhesive bond to harden. However, the arrangement of the adhesive coating is restricted to only a relatively small linear region when, for example, two rows of pockets with encased cylindrical springs are held pressed onto one another. This region becomes even shorter in terms of height when barrel springs are used. This results in a reduced retention of the springs relative to one another and a comparatively low dimensional accuracy of the mattress as a whole. Moreover, there is a problem in pressing on the adhesive coated on the pockets, because the material of the pockets sags or can experience a bulging deformation at the turns of the helical spring between the supporting points.

SUMMARY OF THE INVENTION

U.S. Pat. No. 2,805,429 shows a pocket-spring core mattress consisting of a plurality of interconnected encased barrel springs. To connect the bands or rows of barrel springs to one another in the transverse direction, it is proposed to use connecting threads which are guided through the pockets of all the bands or rows in the transverse direction. These threads are knotted together at the protruding ends on both sides of the pocket-spring core mattress. At the same time, the threads are guided through the pockets of adjacent rows in such a way that they pass alternately through a transition region between two pockets, whilst immediately adjacent to this the connecting thread runs through the movement space of the helical spring. It has already been recognized as a disadvantage there that needles guiding the threads during their passage through the mattress can break off upon contact with the helical springs, and it is therefore proposed to pull the threads through the pockets of all the adjacent bands during the return stroke of the needles. At all events, the threads used impede the free movement of the helical springs. On the other hand, continued movements of the helical springs lead to a fraying of the connecting threads, with the result that retention in the transverse direction is lost.

U.S. Pat. No. 3,230,558 also shows such a pocket-spring core mattress with continuous connecting threads over the entire width of the mattress. Here too, adjacent pockets are impaled on the respective continuous connecting thread or pierced by this.

The object on which the invention is based, starting from a pocket-spring core mattress of the type described in the introduction, is to improve the retention of the rows or bands of pockets transversely relative to the direction of the bands. At the same time, production will also be simplified and disadvantages caused by the shape of the particular helical springs eliminated.

According to the invention, in a pocket-spring core mattress of the type described in the introduction, this is achieved in that, parallel to the direction of the bands, between every two adjacent bands there is a connecting wall made of elastic material, and in that the pockets of the bands are respectively bonded adhesively to one another indirectly via a connecting wall. In contrast to a direct adhesive bonding, such indirect adhesive bonding can be carried out substantially more reliably, because the connecting wall made of elastic material can be brought into mutual contact more effectively and more intensively at the coating points of the adhesive. Furthermore, advantageously special desired properties of the mattress can be influenced because of the insertion of the connecting walls made of the elastic material. Advantageously, the danger of fraying or of mutual catching in the event of a spring break is also reduced, because, on the other hand, the connecting walls again ensure that the helical springs cannot come directly in contact with one another transversely relative to the direction of the bands.

The connecting walls are appropriately provided continuously over the height of the helical springs in the pockets and can have a cross-section matched to the contour of the helical springs. Consequently, although it is still possible to coat the adhesive in a linear region only, this region is nevertheless comparatively extensive, because good contact with the pockets of the helical springs becomes possible as a result of the flexibility of the connecting walls.

If the connecting walls are profiled in the longitudinal direction, thereby being matched to at least part of the periphery of the helical springs, the area in which the adhesive can be coated is also increased considerably in the transverse direction relative to the axis of the helical springs. Moreover, the profiling of the connecting walls is also beneficial insofar as each individual helical spring is thereby additionally held in its place and secured.

The connecting walls can consist of foam material, that is to say of foamed plastic, which moreover can be set to the desired elasticity, so that the properties of the pocket-spring core mattress as a whole can also be influenced positively.

The adhesive bond can consist of several adhesive spots arranged distributed over an area. They can be made strip-like and coated on. Various practical possibilities are open here to a person skilled in the art.

According to the invention, the process for producing such a pocket-spring core mattress is characterized in that the pockets of the bands are bonded adhesively to one another indirectly, because the bands are each bonded adhesively to a connecting wall directly. Although this increases the number of adhesive spots, nevertheless each individual adhesive spot can be made more simply and with greater reliability, because the elastic flexibility of the material of the connecting wall is cleverly utilized for this purpose.

It is possible first to bond a band adhesively to a connecting wall, subsequently to carry out a subdivision into portions of band and connecting wall, and finally to bond the portions adhesively to one another in the same direction. This allows efficient production. Appropriately, the adhesive is coated onto the material of the connecting wall and not onto the material of the pockets.

BRIEF DESCRIPTION OF THE DRAWINGS

The invention is explained further and described by means of preferred exemplary embodiments. In the drawing.

DETAILED DESCRIPTION

Figure 1:
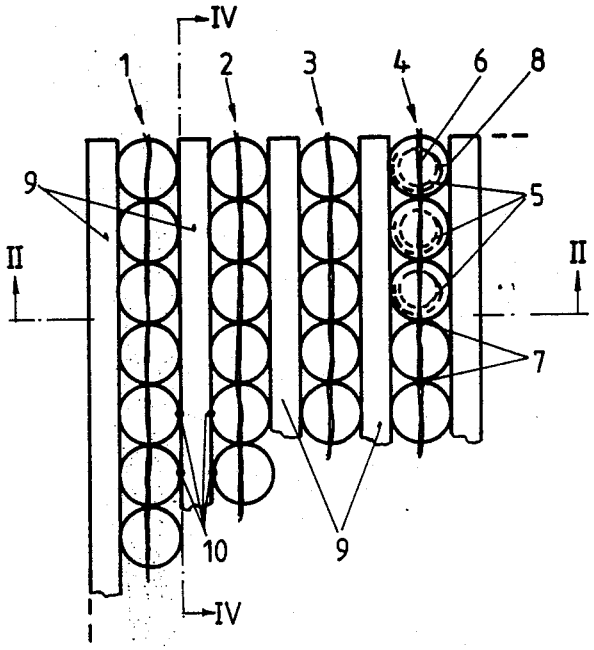
FIG. 1 shows a plan view of part of a pocket-spring core mattress in a first embodiment.

FIG. 1 shows a corner of a pocket-spring core mattress. Bands 1, 2, 3, 4 of pocket springs are respectively arranged alternately, pockets 5 connected to one another being formed from fabric, nonwoven or the like, and being closed off from one another by means of a longitudinal seam 6 and respective transverse seams 7, but being connected to one another. A helical spring 8 is encased in each pocket 5. This design of the bands 1, 2, 3, 4 etc. corresponds to the conventional state of the art.

Figure 2:
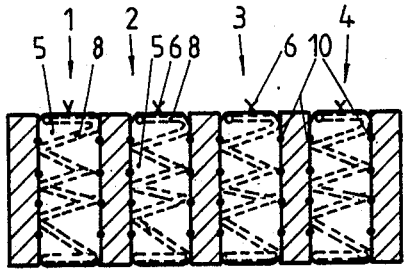
FIG. 2 shows a section along the line II—II in FIG. 1.

Between adjacent bands and also at the start and end there is a respective connecting wall 9 made of elastic material, for example foam material, the connecting walls 9 (FIG. 2) being provided continuously over the height of the helical springs 8 or pockets 5. The width of the connecting walls 9 can amount to a fraction of the diameters of the helical springs 8. Between the material of the pockets 5 and the connecting walls 9 is formed a plurality of individual adhesive spots 10, this appropriately being obtained as a result of a coating of adhesive on the connecting walls 9, against which the bands of pockets 5 are held for the time necessary for hardening. As a result of the flexibility of the material of the connecting walls 9, there is good surface contact in the region of the adhesive spots 10, so that the connection is made firmly and reliably in the region of all the adhesive spots 10. It goes without saying that, in this design, approximately linear contact takes place between the helical springs 8 designed as cylindrical springs and the connecting walls 9, so that the adhesive spots 10 must be placed accordingly. The connecting walls 9 according to FIG. 2 have a rectangular cross-section which is provided constantly continuous over their length.

Figure 3:
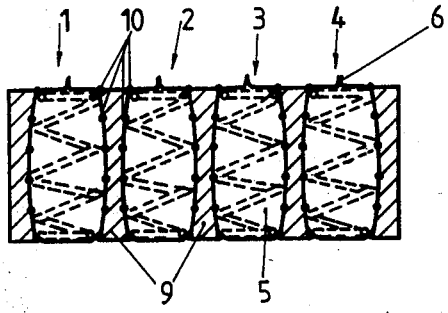
FIG. 3 shows a similar sectional representation to that of FIG. 2, but with barrel springs used.

FIG. 3 illustrates an exemplary embodiment in which the helical springs 8 are designed as barrel springs. Here too, the connecting walls 9 have a cross-section which is constant and continuous over their length, but which is made concave, in order thereby to increase the region in which the adhesive spots 10 can be arranged. As is evident, the adhesive spots 10 can even be arranged in the region of the first and last turn of the helical springs 8, and hitherto this has not been possible at all with the direct adhesive bonding of the pockets 5 of helical springs 8 designed as barrel springs.

Figure 4:
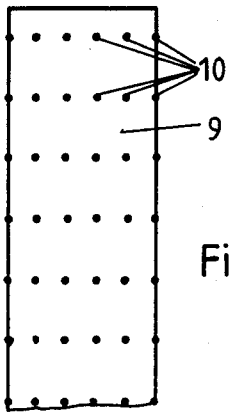
FIG. 4 shows a sectional representation along the line IV—IV in FIG. 1 to illustrate the adhesive spots.
Figure 5:
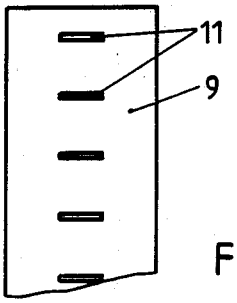
FIG. 5 shows a similar representation to that of FIG. 4 with another arrangement and design of the adhesive spots.

FIG. 4 also illustrates the arrangement of the adhesive spots 10 for the exemplary embodiment of FIG. 3. Of course, according to FIG. 5, it is also possible to concentrate the adhesive bonding onto the middle region of the barrel springs and here apply or arrange the adhesive spots in strip form, in particular as adhesive strips 11.

Figure 6:
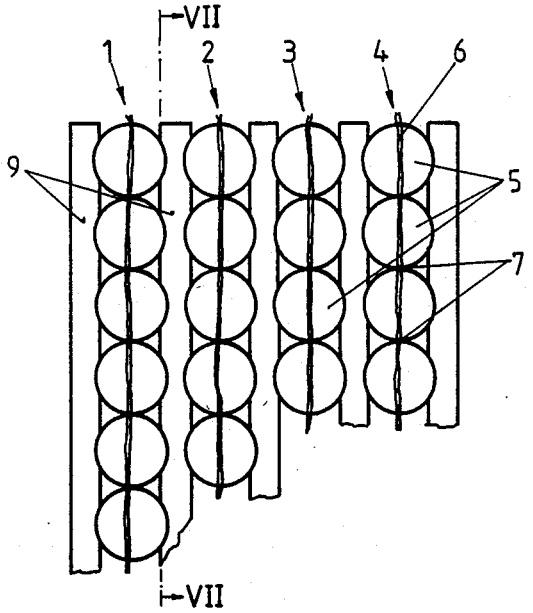
FIG. 6 shows a plan view of a further embodiment of the pocket-spring core mattress.
Figure 7:
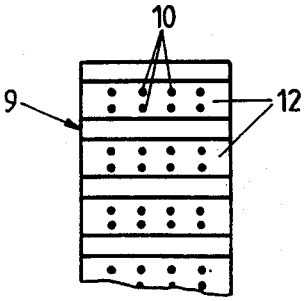
FIG. 7 shows a sectional representation along the line VII—VII in FIG. 6.
Figure 8:
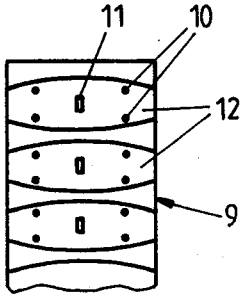
FIG. 8 shows a similar sectional representation to that of FIG. 7, but in a further embodiment.

The exemplary embodiments of FIGS. 6 to 8 show a fundamentally similar design, but here the connecting walls 9 are profiled in the direction of their longitudinal extension, that is to say they have changing cross-sections here. In this way, better matching to the shape of the helical springs over a larger peripheral region is possible, and the zone within which the adhesive spots 10 or the adhesive strips 11 can be arranged becomes considerably larger, that is to say there is a comparatively large area within which the adhesive spots 10 can be arranged virtually as desired. Such zones 12 are shown emphasized in FIGS. 7 and 8. Furthermore, the illustrated profiling of the connecting walls 9 in the longitudinal direction also affords, as it were, a positive connection with the pockets 5 or the helical springs 8 encased in these, so that each helical spring 8 is not only held and secured appropriately by the pockets 5, but additionally by means of the profiling of the connecting walls 9.

The pocket-spring core mattresses of the type described can be produced very simply and economically. The adhesive spots 10 or adhesive strips 11 are expelled mechanically through nozzles of an appropriate adhesivecoating machine, for example in the form of a hot adhesive, and thereby pass onto an endless strip of the connecting wall 9. Subsequently, an endless band 1 of pockets 5 connected to one another and with encased helical springs 8 is pressed on, until the connection is made and hardening has occurred. This double band is then subdivided into band portions, and once again further adhesive spots 10 or adhesive strips 11 are applied especially to the material of the connecting wall. The portions are then held together briefly until hardening occurs here too, good contact being achieved because of the flexibility of the material of the connecting walls 9.

I claim:

1. A pocket-spring core mattress assembly comprising a plurality of interconnected, encased helical springs, each of said springs having a closed pocket of fabric, plastic or the like disposed therearound, said closed pockets being connected to one another to form elongated bands in a first longitudinal direction, said bands having a top, bottom, and opposed sides, a plurality of elastomeric, independent, connecting walls, said walls having a top, bottom, and opposed sides, said walls disposed between said bands in alternating relationship, and adhesive means disposed between the sides of said walls and said bands for indirectly bonding said bands together in a transverse direction relative to the direction of said bands.

2. A pocket-spring core mattress assembly as defined in claim 1 in which said connecting walls are substantially equal in height to said springs and in which said walls have a cross-section corresponding to the contour of said springs.

3. A pocket-spring core mattress assembly as defined in claim 1 in which said connecting walls are profiled in the longitudinal direction by varying the cross section for being matched to at least part of the periphery of said springs.

4. A pocket-spring core mattress assembly as defined in claim 1 in which said connecting walls are composed of foam material.

5. A pocket-spring core mattress assembly as defined in claim 1 in which said adhesive means includes a plurality of adhesive spots distributed over an area of said walls between said bands.

6. A pocket-spring core mattress assembly comprising a plurality of interconnected, encased helical springs, each of said springs having a closed pocket of fabric, plastic or the like disposed therearound, said closed pockets being connected to one another to form elongated bands in a first longitudinal direction, said bands having a top, bottom, and opposed sides, a plurality of elastometric, independent, connecting walls, said walls having a top, bottom, and opposed sides, said walls disposed between said bands in alternating relationship, and adhesive means disposed between the sides of said walls and said bands for indirectly bonding said bands together in a transverse direction relative to the direction of said bands, said adhesive means comprising several adhesive spots distributed over an area of said connecting wall confronting said closed pockets of said helical springs.

* * * * *